US005833561A

United States Patent [19]

Kennedy et al.

[11] Patent Number: 5,833,561

[45] Date of Patent: Nov. 10, 1998

[54] BALL BAT WITH TAILORED FLEXIBILITY

[75] Inventors: Thomas Kennedy, Wilbraham, Mass.; Brian Feeney, Enfield, Conn.

[73] Assignee: Lisco, Inc., Tampa, Fla.

[21] Appl. No.: 789,346

[22] Filed: Jan. 27, 1997

[51] Int. Cl.[6] ..... A63B 59/06

[52] U.S. Cl. ..... 473/564; 473/566; 473/567

[58] Field of Search ..... 473/564, 566, 473/568, 567, 520

[56] References Cited

U.S. PATENT DOCUMENTS

| | | | |
|---|---|---|---|
| 537,927 | 4/1895 | Kennedy | 473/520 |
| 546,540 | 9/1895 | Kennedy | 473/520 |
| 1,509,733 | 9/1924 | Langford | 473/520 |
| 2,031,161 | 2/1936 | Hamel | 473/568 |
| 4,940,247 | 7/1990 | Magadini | 473/566 |
| 5,131,651 | 7/1992 | You | 473/520 |
| 5,516,097 | 5/1996 | Huddleston | 473/564 |

*Primary Examiner*—Mark S. Graham

[57] ABSTRACT

The present invention relates to a ball bat with tailored flexibility with a cylindrical handle zone at a first end of the ball bat. The cylindrical handle zone has a knob disposed on a free end thereof. A generally cylindrical hitting zone is at a second end of the ball bat remote from the first end. An essentially frustoconical transition zone is between the handle zone and the hitting zone. The transition zone includes an inboard portion of a first length and an outboard portion of a second length together forming a flex control zone. The flex control zone modifies normal flex characteristics of the ball bat.

1 Claim, 3 Drawing Sheets

BALL BAT WITH TAILORED FLEXIBILITY

BACKGROUND OF THE INVENTION

1. Field of the Invention

The present invention relates to a ball bat with tailored flexibility and, more particularly, to such a ball bat with tailored flexibility for allowing for improved swing characteristics.

2. Description of the Prior Art

The use of ball bats with tailored flexibility is known in the prior art. Furthermore, the use of baseball bats is also known in the prior art. These baseball bats describe prior art baseball bats for striking a ball.

The literature discloses various baseball bats of varying construction. Note U.S. Pat. No. 4,351,786 to Mueller. This patent relates to composite bowling pins and baseball bats which are formed with foam, cured in place plastic bodies securely adhered to a central aluminum core by a somewhat thermoplastic adhesive coating. U.S. Pat. No. 5,131,651 to You. This patent relates to a ball bat of fiber-reinforced plastic casing of a pre-determined thickness with slits of a pre-determined number constructed in the casing located at the juncture area of flexible bending portion and grip portion. U.S. Pat. Des. 5,316,299 to Feche. This patent relates to a golf club shaft with a small central section adjacent to the handle or upper end. U.S. Pat. No.

5,348,296 to Frederiksen. This patent relates to a composite bat formed of a stiff core having a thick sheet of an elastomer such as polyurethane. U.S. Pat. No. 5,452,889 to Lewinski, et al. This polyurethane. U.S. Pat. No. 5,452,889 to Lewinski, et al. This patent relates to a device for striking a ball such as a soft foam rubber ball, and includes a ball striking element including a clear transparent shell portion and a colored liquid in an inter-cavity in the shell portion. U.S. Pat. No. 5,516,097 to Huddleston. This patent relates to a bat made up of a resilient conical coupling tube between spaced other portions of the bat. U.S. Pat. DES. 344,777 to Lo. This is a design patent directed to a bat which has conical or reverse frustoconical sections in the handle area and an enlarged bulb-like section close to the handle. U.S. Pat. No. 3,877,698, to Volpe, relates to a baseball bat with a replaceable ball-striking portion. U.S. Pat. Des. 4,032,143 to Mueller, relates to a composite baseball bat.

However, none of these baseball bats are capable of allowing for improved swing characteristics as provided by the present invention.

The present invention achieves its intended purposes, objects and advantages over the prior art through a new, useful and unobvious combination of components elements, through the use of a minimum number of functioning parts, at a reasonable cost to manufacture, and through the utilization of only readily available and conventional materials.

Therefore, it is an object of the present invention to provide an improved ball bat with tailored flexibility with a cylindrical handle zone at a first end of the ball bat. The cylindrical handle zone has a knob disposed on a free end thereof. A generally cylindrical hitting zone is at a second end of the ball bat remote from the first end. An essentially frustoconical transition zone is between the handle zone and the hitting zone. The transition zone includes an inboard portion of a first length and an outboard portion of a second length together forming a flex control zone. The flex control zone modifies normal flex characteristics of the ball bat.

Therefore, it is an object of this invention to provide a ball bat with tailored flexibility which overcomes the aforementioned inadequacies of the prior art devices and which constitutes an improvement which is a significant contribution to the advancement of the art.

Another object of the invention to enable ball bat with tailored flexibility that allows for improved swing characteristics.

It is a further object of the present invention to provide such a ball bat with tailored flexibility that includes a reduced circumferential area between the cylindrical handle and the barrel for forming a bubble for selective stiffening and flex to be incorporated into a softball or baseball bat.

It is another object of the present invention to provide a ball bat with tailored flexibility which may be easily and efficiently manufactured and marketed.

It is further object of the present invention to provide a ball bat with tailored flexibility construction which is of a durable and reliable construction.

The foregoing has outlined some of the more pertinent objects of the present invention. These objects should be construed to be merely illustrative of some of the more prominent features and applications of the intended invention. Many other beneficial results could be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention as defined by the claims taken in conjunction with the accompanying drawings.

SUMMARY OF THE INVENTION

The invention is defined by the appended claims with the specific embodiment shown on the attached drawings. For the purposes of summarizing the invention, the invention essentially comprises a ball bat with tailored flexibility for allowing for improved swing characteristics.

The present invention includes a cylindrical handle zone at a first end of the ball bat. The cylindrical handle zone has a knob disposed on a free end thereof. The cylindrical handle zone has a length of about one-third of an overall length of the ball bat. A generally cylindrical hitting zone is at a second end of the ball bat remote from the first end. The hitting zone has a length of about one-third of the overall length of the ball bat and essentially equal to the length of the cylindrical handle zone. An essentially frustoconical transition zone is between the handle zone and the hitting zone. The transition zone has a length of about one-third of the overall length of the ball bat. The transition zone includes an inboard portion of a first length in a frustoconical configuration. The inboard portion has a lower end integral with and having an essentially equal diameter as an upper end of the cylindrical hitting zone. The transition zone includes an outboard portion of a second length in a frustoconical configuration. The second length is about five times greater than the first length. The outboard portion has a lower end integral with and having an essentially equal diameter as a lower end of the hitting zone. An upper end of the inboard portion and a lower end of the outboard portion integrally form a flex control zone. The flex control zone modifies normal flex characteristics of the ball bat. The flex control zone has a diameter at a widest portion thereof greater than 2.5 times a diameter of the cylindrical handle zone.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. Its should be appreciated by those skilled in the art that the conception and the disclosed specific embodiment may be readily utilized as a basis for modifying or designing other structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

The same reference numerals refer to the same parts through the various Figures.

DESCRIPTION OF THE PREFERRED EMBODIMENT

The present invention relates to a ball bat with tailored flexibility 10 for allowing for improved swing characteristics. In its broadest context, the present invention includes a cylindrical handle zone at a first end of the ball bat. The cylindrical handle zone has a knob disposed on a free end thereof. A generally cylindrical hitting zone is at a second end of the ball bat remote from the first end. An essentially frustoconical transition zone is between the handle zone and the hitting zone. The transition zone includes an inboard portion of a first length and an outboard portion of a second length together forming a flex control zone. The flex control zone modifies normal flex characteristics of the ball bat. The various components of the present invention, and the manner in which they interrelate, will be described in greater detail hereinafter.

Figure 1:
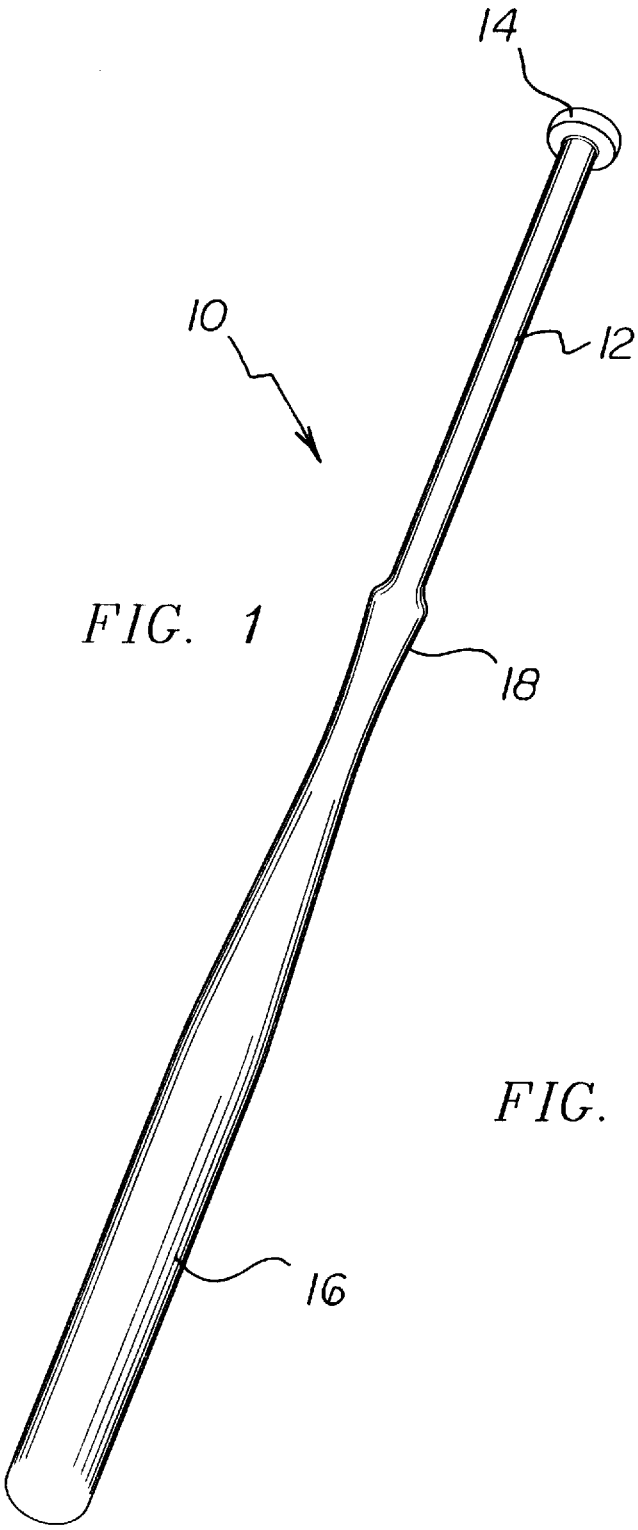
FIG. 1 is a perspective view of the preferred embodiment of the ball bat fabricated of a hybrid composite and metal with tailored flexibility constructed in accordance with the principles of the present invention.
Figure 2:
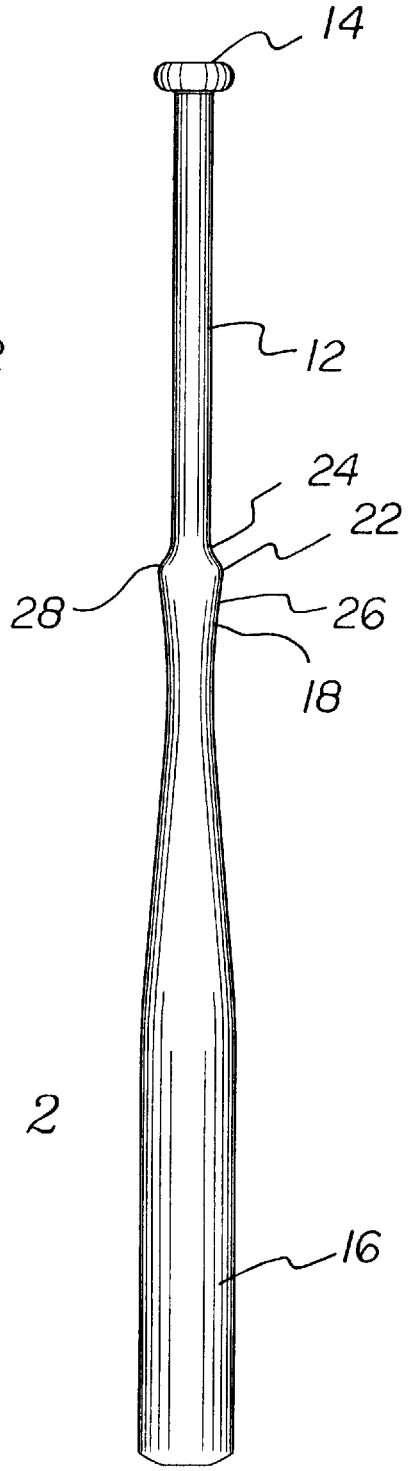
FIG. 2 is a front elevation view of the preferred embodiment of the present invention.
Figure 3:
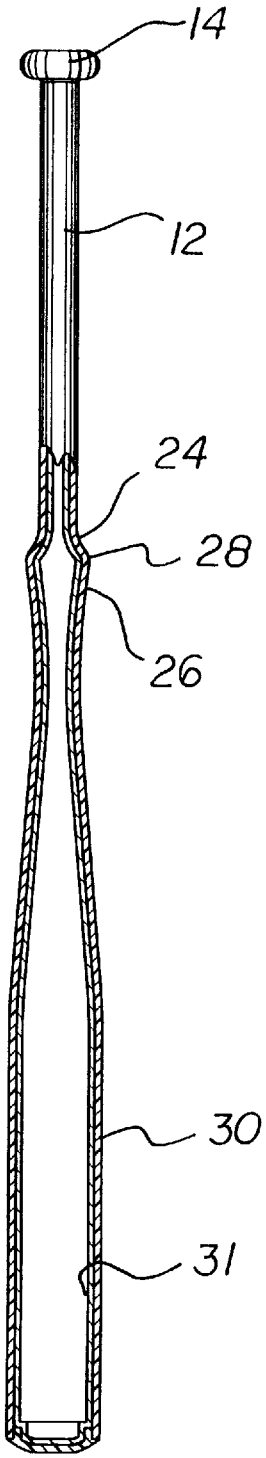
FIG. 3 is a front elevational view of the preferred embodiment of the present invention shown in cross-section.

The ball bat 10, in the preferred embodiment, as illustrated in FIGS. 1 through 3, is fabricated of a hybrid composite/aluminum material. The ball bat 10 includes a cylindrical handle zone 12 at a first end of the ball bat 10. The cylindrical handle zone 12 has a knob 14 disposed on a free end thereof. The cylindrical handle zone 12 has a length of about third of an overall length of the ball bat 10. The length of the cylindrical handle zone 12 is long enough to accommodate both hands of a user whereby the user can adjust the positioning of his/her hands along the length of handle zone 12 so as to comfortably manipulate the ball bat 10.

A generally cylindrical hitting zone 16 is at a second end of the ball bat 10 remote from the first end. As illustrated in FIGS. 1 through 3, the hitting zone 16 has a length of about one-third of the overall length of the ball bat 10 and essentially equal to the length of the cylindrical handle zone 12.

An essentially frustoconical transition zone 18 is between the handle zone 12 and the hitting zone 16. The transition zone 18 has a length of about one-third of the overall length of the ball bat 10. The transition zone 18 includes a frustoconical region 20 and a flex control region 22. The flex control region 22 includes an inboard portion 24 of a first length in a frustoconical configuration. The inboard portion 24 has a lower end integral with and having an essentially equal diameter as an upper end of the cylindrical handle zone 12. The flex control region 22 includes an outboard portion 26 of a second length in a frustoconical configuration. The second length is about five times greater than the first length. An upper end of the inboard portion 24 and a lower end of the outboard portion 26 integrally form an enlarged annular ring 28. The flex control region 22 modifies normal flex characteristics of the ball bat 10. The flex control normal flex characteristics of the ball bat 10. The flex control region 22 has a diameter at a widest portion thereof greater than 2.5 times a diameter of the cylindrical handle zone 12.

FIG. 3 illustrates the composite layer 30 as the outer layer and the metal layer 31 as the interior layer.

Figure 4:
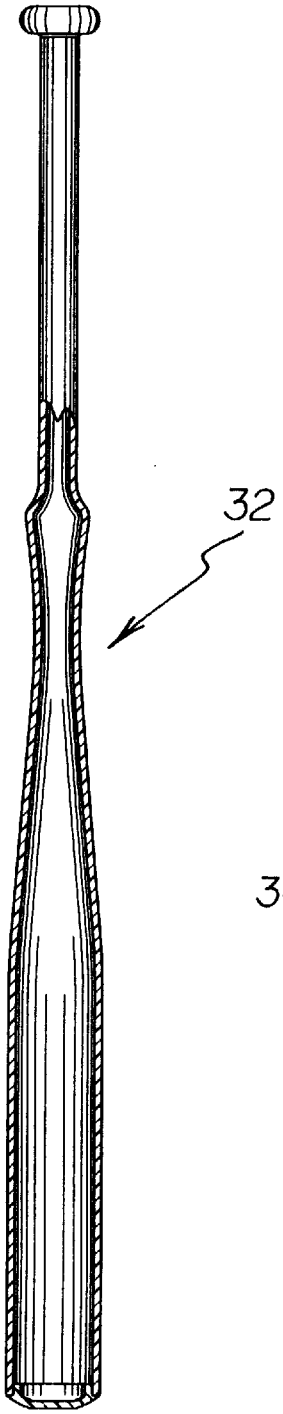
FIG. 4 is a front elevation view of a second embodiment of the present invention shown in cross-section.

FIG. 4 illustrates a second embodiment of the present invention that is fabricated of a metal, preferably aluminum, material. The second embodiment is a bat 32 of the same dimensions as that of the preferred embodiment.

Figure 5:
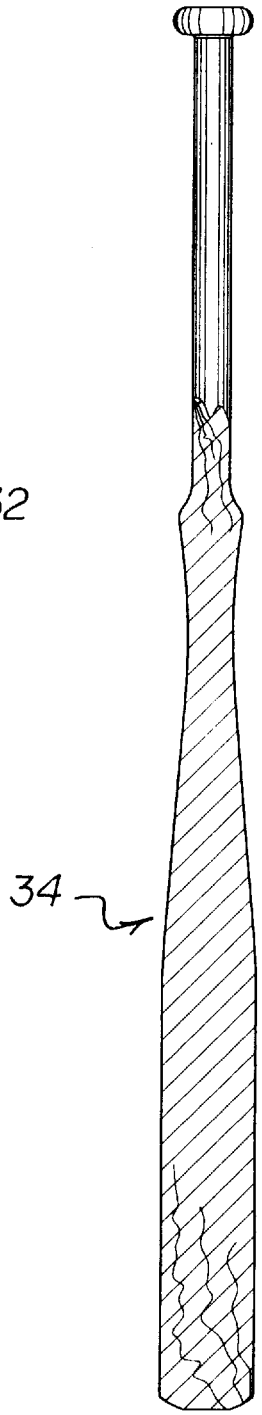
FIG. 5 is a front elevation view of a third embodiment of the present invention shown in cross-section.
Figure 6:
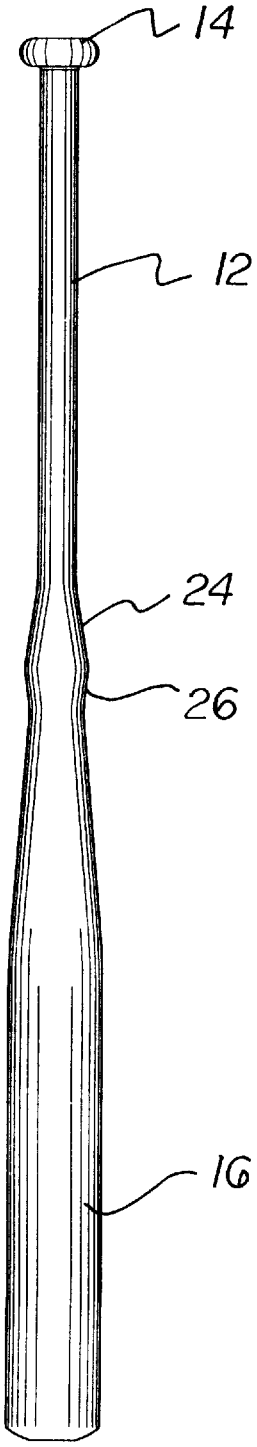
FIG. 6 is a front elevation view of a fourth embodiment of the present invention.

FIGS. 5 through 8 illustrate further alternate embodiments of the present invention. FIG. 5 illustrates the ball bat 12 constructed in the same dimensions as that of the preferred embodiment with a bat 34 fabricated of a wood material, such as ash. FIG. 6 illustrates a longer cylindrical handle 12 as associated with a softball bat. The ball bat 10 includes a flex control region 22 with its inboard end 24 with a length twice as long as the outboard end 26.

Figure 7:
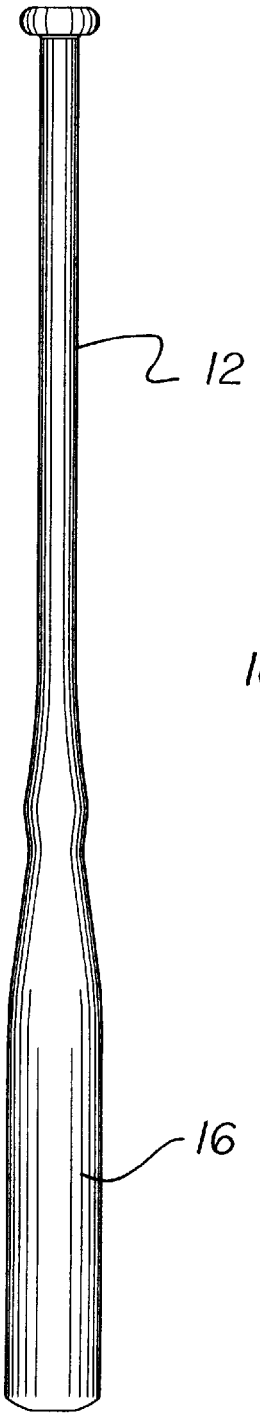
FIG. 7 is a front elevation view of a fifth embodiment of the present invention.

FIG. 7 illustrates an elongated cylindrical handle zone 12 that extends over half of the overall length of the ball bat 10. The hitting zone 16 is also reduced to less than one-third of the overall length of the ball bat 10. This will increase the flexibility of the ball bat 12.

Figure 8:
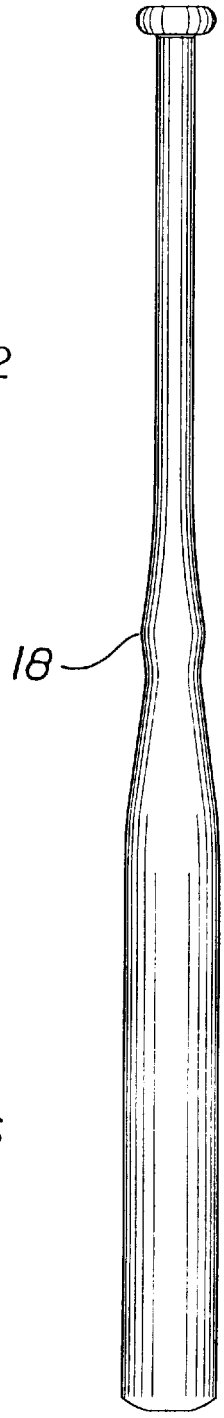
FIG. 8 is a front elevation view of a sixth embodiment of the present invention.

FIG. 8 illustrates the ball bat 10 with the transition zone 18 being of a reduce length. The transition zone 18 as shown in FIG. 7 is less than twenty-five percent of the overall length of the ball bat 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ball bat with tailored flexibility for use in allowing for improved swing characteristics:

a cylindrical handle zone at a first end of the ball bat, the cylindrical handle zone having a knob disposed on a free end thereof, the cylindrical handle zone having a length of about one-third of an overall length of the ball bat;

a generally cylindrical hitting zone at a second end of the ball bat remote from the first end, the hitting zone having a length of about one-third of the overall length of the ball bat and essentially equal to the length of the cylindrical handle zone;

an essentially frustoconical transition zone between the handle zone and the hitting zone, the transition zone having a length of about one-third of the overall length of the ball bat, the transition zone including a frustoconical region and a flex control region, the frustoconical region being adjacent to the hitting zone, the flex control region being adjacent to the handle zone, the flex control region including an inboard portion of a first length in a frustoconical configuration, the inboard portion having a lower end integral with and having an essentially equal diameter as an upper end of the cylindrical handle zone, the flex control region including an outboard portion of a second length in a frustoconical configuration, the second length being about five times greater than the first length, an upper end of the inboard portion and a lower end of the outboard portion integrally forming an enlarged annular ring, the flex control region modifying normal flex characteristics of the ball bat, the enlarged annular ring having a diameter at a widest portion thereof greater than 2.5 times a diameter of the cylindrical handle zone.

* * * * *